US010165363B2

(12) United States Patent
Every et al.

(10) Patent No.: US 10,165,363 B2
(45) Date of Patent: Dec. 25, 2018

(54) ACTIVE NOISE EQUALIZATION

(71) Applicant: 2236008 Ontario Inc., Waterloo (CA)

(72) Inventors: Mark Robert Every, Surrey (CA); Kyle Tegan MacDonald, Vancouver (CA); Michael Andrew Percy, Vancouver (CA)

(73) Assignee: 2236008 Ontario Inc., Waterloo, Ontario (CA)

( * ) Notice: Subject to any disclaimer, the term of this patent is extended or adjusted under 35 U.S.C. 154(b) by 0 days.

(21) Appl. No.: 15/719,201

(22) Filed: Sep. 28, 2017

(65) Prior Publication Data

US 2018/0020289 A1 Jan. 18, 2018

Related U.S. Application Data

(63) Continuation of application No. 14/245,142, filed on Apr. 4, 2014, now Pat. No. 9,788,112.

(60) Provisional application No. 61/808,943, filed on Apr. 5, 2013.

(51) Int. Cl.
*H04R 3/04* (2006.01)
*G10K 11/178* (2006.01)

(52) U.S. Cl.
CPC ..... *H04R 3/04* (2013.01); *G10K 11/178* (2013.01)

(58) Field of Classification Search
None
See application file for complete search history.

(56) References Cited

U.S. PATENT DOCUMENTS 6,009,360 A * 12/1999 Knapp ..... G09G 1/162 701/29.4
9,788,112 B2 * 10/2017 Every ..... H04R 3/04
2013/0039507 A1 * 2/2013 Park ..... G10K 11/1788 381/71.6
2014/0274198 A1 * 9/2014 Miller ..... H04W 88/02 455/550.1

FOREIGN PATENT DOCUMENTS

EP 1577879 A1 9/2005

OTHER PUBLICATIONS

EPO, EP Examination Report relating to EP application No. 14163536.7, dated Jun. 13, 2018.

* cited by examiner

*Primary Examiner* — Creighton Smith
(74) *Attorney, Agent, or Firm* — Rowand LLP

(57) ABSTRACT

An active noise equalization (ANE) system may be run on the existing audio/infotainment system as a software library. The ANE system may share components (e.g., microphones and sensors) with other audio applications. Some ANEs include a complex-domain formulation of a multiple-frequency multiple-channel ANE that requires less memory and processing requirements. The complex-domain system replaces the multiplication of multiple real gains with multiple real signals with a single complex multiplication operation.

21 Claims, 4 Drawing Sheets

ACTIVE NOISE EQUALIZATION

CROSS-REFERENCE TO RELATED APPLICATIONS

This application is a continuation of U.S. application Ser. No. 14/245,142, which is now U.S. Pat. No. 9,788,112, which claims priority to U.S. Provisional Patent Application Ser. No. 61/808,943, filed Apr. 5, 2013, the entirety of both are incorporated herein by reference.

BACKGROUND

Technical Field

The present disclosure relates to the field of active noise control. In particular, to a system for active noise equalization.

Related Art

Significant improvements in fuel-efficiency of vehicles have been achieved through adoption of new engine management and drive-train technologies. Examples include cylinder deactivation and lower engine speed (a.k.a. lower RPM) torque. In some cases these technologies result in objectionable interior cabin noise, otherwise known as "boom", as a result of increased vibrational energy produced in the engine and/or drive-train being transmitted into acoustic energy inside the cabin. More conventional engine management and drive-train technologies may also lead to objectionable interior cabin noise, however, these newer technologies tend to exacerbate the problem. The objectionable engine noise is typically low-frequency (for example, less than 100 Hz), tonal (one or more tones which may be harmonically related), and with frequency proportional to engine speed. Vehicle noise characteristics are a quality factor in the overall driving experience, and interior sound quality is often marketed as a strong selling point. There are also potential health and safety implications of interior cabin noise. Long-term exposure to high-amplitude low-frequency noise (LFN), particularly in the infrasonic range (below 20 Hz), has been linked to vibro-acoustic disease. Vibro-acoustic disease has been observed amongst aircraft technicians, commercial and military pilots and cabin crew-members, ship machinists, restaurant workers, and disk-jockeys. LFN is also a cause of driver fatigue in cars, trucks, and buses.

Passive noise control methods are used to reduce interior cabin noise. This approach includes the use of acoustically absorptive and damping materials and the use of deflectors/baffles to reflect sound energy away from the cabin interior. However, there are many disadvantages of passive noise control approaches. For example, passive noise control materials add weight to the vehicle, thus reducing fuel efficiency. The approach is also costly, in terms of raw materials, time and effort to incorporate these stages into the production line. Furthermore, the effectiveness of passive noise control is reduced as the frequency of the disturbance is lowered, such that only the most expensive and impractical of passive noise control mechanisms would be effective at 50 Hz, for example.

Another means to reduce interior cabin noise is active vibration control, for example, active engine mounts, which compensate for vibrations introduced into the chassis via the engine mount by providing controlled energy to the mounting system. Active engine mounts consist of passive mounts, force generating actuators, sensors, and electronic controllers, and may provide superior vibration isolation capabilities compared to conventional passive elastomeric and hydraulic engine mounts. The superior vibration isolation capabilities of active mounts may also allow for the elimination of an engine balancer shaft, reducing engine weight, height, and cost, and helping to achieve fuel efficiency. There are various limitations and trade-offs that must be made in selecting an active vibration control mechanism: bandwidth, response time, displacement, efficiency, effectiveness, stiffness, weight, size and realizable force. These approaches typically require dedicated actuators, controllers and sensors, so there is a significant expense in manufacturing these systems.

Given that the characteristics of automotive engine noise are typically low-frequency, tonal, and predictable (assuming engine speed is known), active noise control (ANC) is suited to the task of actively reducing the noise inside the vehicle cabin. The basic principle of these systems is that a primary acoustic noise component may be cancelled at a given location by superimposing a secondary acoustic component or "anti-noise" component of equal amplitude but opposite phase. An ANC system requires sensors (e.g. microphones or accelerometers), actuators (e.g. loudspeakers, subwoofers, electrostatic transducer panels), and one or more controller modules. Automotive ANC systems have reused existing audio or infotainment system hardware such as loudspeakers, amplifiers and analog-digital converters, to reduce cost of implementation. However, current commercial ANC systems rely on separate and dedicated hardware controller modules and dedicated input sensors/microphones. These components have a significant cost, the process of integrating the ANC solution with the audio system requires significant integration, wiring and tuning effort, offers little extensibility, provides no easy solution to managing audio power headroom, are expensive to replace, and place restrictions on after-market modifications of the audio system.

FIG. 1 is a block diagram of a single-frequency active noise equalizer (ANE). Whereas the design of an ANC system usually pursues maximal attenuation of the incoming noise, an ANE system 100 reduces the engine noise, created in a noise source 102, to a desired level, or in some cases, may even be used to amplify the engine noise. This can be used to provide the driver with audible feedback related to the engine operation, to allow safe operation of the vehicle, or simply to improve the driver's enjoyment. The desired level of noise can be specified a priori using, for example, a spectral template.

A sine-wave generator 104, may be used to generate a sinusoidal reference signal referred to as a noise model 122, $x_0(n)=A\cos(\omega_0 n)$, where A and $\omega_0$ are the amplitude and frequency of the noise model 122, respectively. $\omega_0$ may be synchronized to the engine speed, which may be obtained as a sync signal 120, for example, from a tachometer or directly from the vehicle's Engine Control Unit (ECU). For example, $\omega_0$ may be a multiple of the engine cylinder firing frequency. The noise model 122 $x_0(n)$ is passed through a 90° phase-shifter 106, which may be a time-domain filter that delays the phase of the noise model 122 to produce $x_1(n)=A\sin(\omega_0 n)$. Adaptive gains $g_0(n)$ and $g_1(n)$ are applied to $x_0(n)$ and $x_1(n)$, respectively, and the results are summed to produce y(n). y(n) is multiplied by an adaptive gain $(1-\beta)$ 108, producing the control output signal 124, which is sent to an actuator to produce the "anti-noise" or cancelling signal. P(z) 110 and S(z) 112 are the actual primary and secondary path transfer functions, respectively. The output of the primary transfer function P(z) 110 may represent a sound field in the acoustic space containing the primary acoustic noise component associated with the noise source 102. The output of the secondary path transfer function S(z) 112 may represent a sound field in the acoustic space containing the control output signal 124 referred to as the "anti-noise" or cancelling signal. $g_0(n)$ and $g_1(n)$ may be adapted using an adaptive filtering algorithm 114, such as for example, a least-mean-square (LMS), a normalized LMS (NLMS), affine projection or a recursive least-square (RLS). Two inputs to the adaptive filter are $x_0(n)$ and $x_1(n)$ each filtered by a time-domain estimate of the secondary path transfer function $\hat{S}(z)$ 116. A third input is e'(n), which is a pseudo-error signal 128 obtained by subtracting the output of the balancing branch from an error microphone/sensor signal e(n) 126. The balancing branch includes scaling y(n) using an adaptive balancing gain 118, β, and a time-domain filtering operation using the estimate of the secondary transfer function $\hat{S}(z)$ 116. The error microphone/sensor signal e(n) 126 may capture an audio signal representing a sound field in the acoustic space containing any one or more of the primary acoustic noise component, the cancelling signal and other environmental noise.

There are at least three time-domain filtering operations by $\hat{S}(z)$ 116 per sample in the ANE 100. A reasonable estimate of the impulse response of the secondary path transfer function may be around 100 ms in duration for an automotive interior, or 100 samples at a nominal sample rate of 1 kHz. The complexity rapidly expands for a multiple-frequency multiple-channel system. For example, for J=3, K=4 and M=5, the number of multiply operations arising solely from secondary path filtering is at least 3*100*3*4*5=18000 per sample, or equivalently 18 MHz, which may be a significant burden on available computing power. Furthermore, the hardware on which the ANE system is running may have memory limitations that do not allow for storage of lengthy secondary path impulse responses. For example, for the same system exemplified above, 3*4*100*4=4.8 kB would be required to store the impulse responses in single precision floating-point (4 bytes/word). In addition, memory is required to store past values of the input signals to the secondary path filters, for example, x(n), x(n−1), . . . , x(n−99). Estimates of the secondary path transfer functions may be obtained using offline or online secondary path modeling, for example, by injecting random noise into each control output and adapting a secondary path impulse response estimate using LMS to minimize the difference between the actual and predicted signal at each error microphone.

Thus the known methods for ANE have significant memory requirements and computational complexity.

BRIEF DESCRIPTION OF DRAWINGS

The system and method may be better understood with reference to the following drawings and description. The components in the figures are not necessarily to scale, emphasis instead being placed upon illustrating the principles of the disclosure. Moreover, in the figures, like referenced numerals designate corresponding parts throughout the different views.

Figure 1:
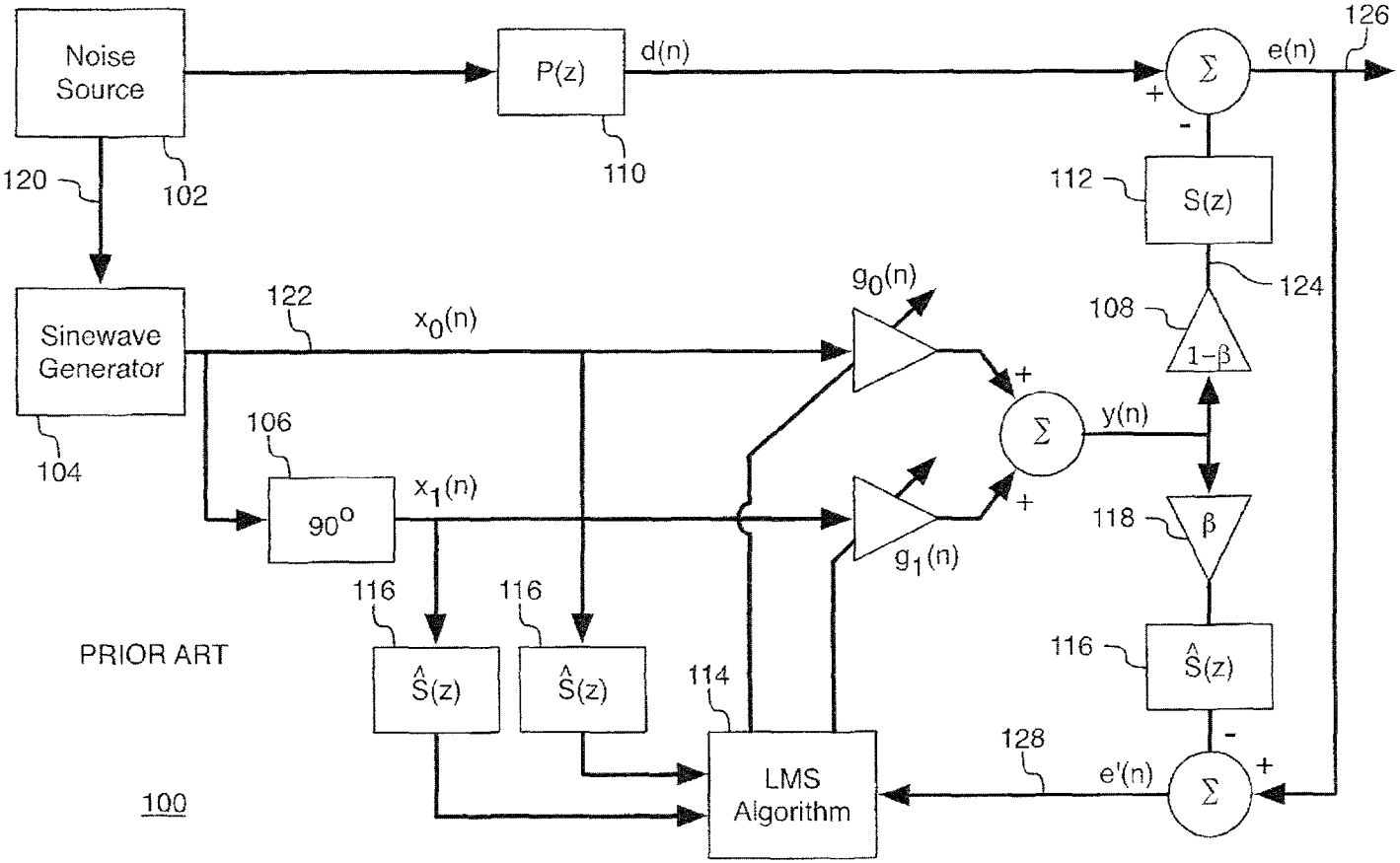
FIG. 1 is a block diagram of a single-frequency active noise equalizer (ANE).

Other systems, methods, features and advantages will be, or will become, apparent to one with skill in the art upon examination of the figures and detailed description. It is intended that all such additional systems, methods, features and advantages be included with this description and be protected by the claims that follow.

DETAILED DESCRIPTION

A system and method for active noise equalization (ANE) disclosed herein may provide cost savings in the implementation of ANE. A sync signal associated with a noise source reproduced into an acoustic space may be obtained. The noise source may be, for example, engine noise in a vehicle. A noise model may be generated responsive to the sync signal. The noise model may represent the noise source with a complex tone generator. An audio signal may be received representing a sound field in the acoustic space. The audio signal may include the noise source. A transformation function may be applied to the noise model where the transformation function is responsive to reducing the sum of the output of the transformation function and the received audio signal. The transformation function may be a complex-domain adaptive filter.

Vehicle infotainment systems typically perform a variety of audio processing tasks, such as hands-free processing, voice recognition, spatial rendering and adaptive equalization, and have the computing resources available to perform these, e.g., digital signal processors (DSP) or application processors in the head-unit or amplifier. Therefore ANE, as a software library, may be run on the existing audio/infotainment system. By eliminating a separate dedicated hardware controller module, the cost and integration effort in enabling ANE may be significantly reduced. Furthermore, the ease of communicating information between different audio systems or the ability to allow those systems to interact, such as when managing audio power headroom, may be significantly enhanced using a software based ANE solution. By providing an ANE software system as a compiled library, a host application or applications processor may remain in full control of the audio processing chain and enable ANE functionality through the software library's API. Further advantages of software (stored on a non-transitory media) include extensibility, lower cost of integration and customization, easier extraction of diagnostic information from the controller module and lower cost of maintenance.

In an alternative system, an ANE software library is used in or accessed through a dedicated controller module, and may also be processed in other non-automotive applications such as, for example, by systems that suppress noise from aircraft, heating and ventilation or manufacturing processes.

A further cost savings can be achieved by dual usage (e.g., sharing) of microphones/sensors for ANE and for other audio applications such as hands-free processing, speech recognition or in-car/seat-to-seat communications. The positions and specifications of these sensors may be jointly optimized for all applications that use them.

Figure 2:
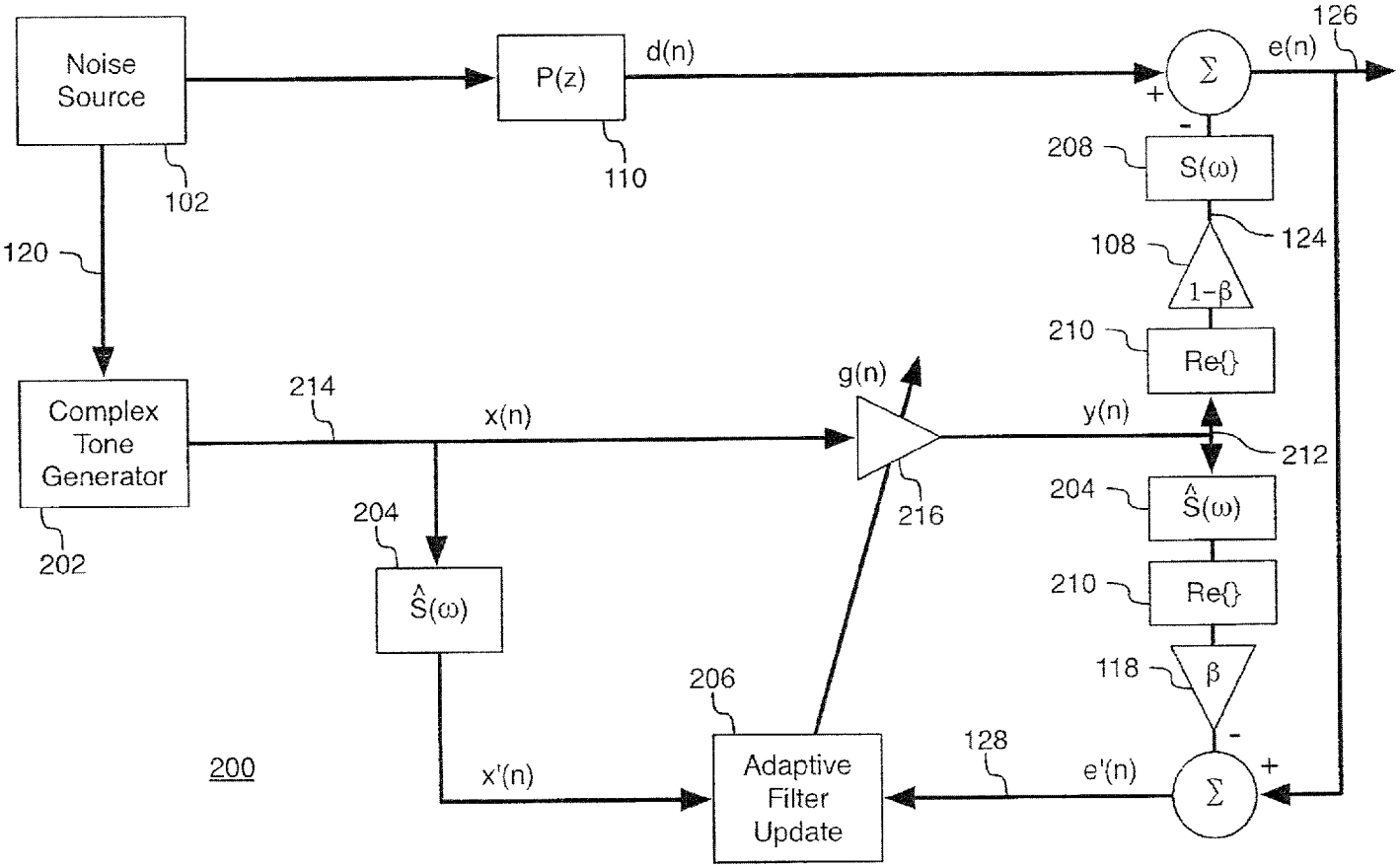
FIG. 2 is a schematic representation of a single-frequency single-channel system for ANE.

The system and method for active noise equalization may comprise a complex-domain formulation of a multiple-frequency multiple-channel ANE with a reduced memory and computational footprint. FIG. 2 is a schematic representation of a single-frequency single-channel system for ANE 200. For a single-frequency system, a noise model generator 202, or complex tone generator, may generate a complex reference signal, or noise model 214, $x(n)=A\exp(i\omega n)$ that is constructed from both real (i.e., $\cos(\omega n)$) and imaginary (i.e., $\sin(\omega n)$) components. Similarly, a multiple-frequency system with M frequencies may contain M complex noise models 214, $x_m(n)=A_m\exp(i\omega_m n)$, where $m=1, 2, \ldots, M$. Secondary path transfer functions $S(\omega)$ 208 from each of K outputs/actuators to each of J error microphones, for example, estimated $\hat{S}(\omega)$ 204 using the random noise injection method, may be computed or "calibrated" offline in a tuning or integration phase. The estimate of the secondary path transfer function 204 may then be transformed offline, either internally or externally to the ANE library, into the frequency-domain using a transform such as a Fast Fourier Transform (FFT) or Discrete Fourier Transform (DCT). ANE for automotive engine noise may only be needed in a limited frequency range, for example, between about 40 Hz and about 80 Hz. Thus, the output of the frequency transforms of the estimate of the secondary path transfer function 204 may be discarded outside of a frequency region of interest. For example, if a 256-point FFT is computed on the estimate of the secondary path transfer function 204 sampled at 1 kHz, the frequency region of interest will contain $256*(80-40)/1000\approx 10$ frequency bins. Assuming single precision floating-point values for the complex FFT spectrum, i.e. 8 bytes per complex value, the storage required for a system with J=3 and K=4 is 3*4*10*8=960 bytes. This represents a factor of 5 in memory savings compared to storing the estimate of the secondary path transfer function 204 in the time-domain. Also, unlike the conventional approach, there is no need to store past values of the input signals to the secondary path filters, as will be seen below.

The filtering operations represented by the $\hat{S}(\omega)$ 204 blocks in FIG. 2 are computed using a complex multiplication, whereas in the $\hat{S}(z)$ 116 example illustrated in FIG. 1, they are computed using a time-domain filtering operation. Suppose $\omega(n)$ is the frequency of a reference tone at time n, which in general does not correspond exactly to any particular frequency bin. The secondary path spectrum at $\omega(n)$ can be found by searching for the nearest frequency bin to $\omega(n)$, or using any of a frequency interpolation method upon the stored secondary path spectrum, such as linear, cubic or spline interpolation. Thus may be obtained $\hat{S}(\omega(n))=s_{\omega(n)}\exp(i\phi_{\omega(n)})$ where $s_{\omega(n)}$ and $\phi_{\omega(n)}$ are the interpolated amplitude and phase of the secondary path spectrum, respectively. Replacing $\omega(n)$ with $\omega$ for simplicity, the secondary path filtering operation of the noise model 214 becomes:

$$x'(n)=x(n)*\hat{S}(\omega)=A\,s_\omega\exp(i(\omega n+\phi_\omega))=(Re\{x(n)\}*Re\{\hat{S}(\omega)\}-Im\{x(n)\}*Im\{\hat{S}(\omega)\})+i(Re\{x(n)\}*Im\{\hat{S}(\omega)\}+Im\{x(n)\}*Re\{\hat{S}(\omega)\}).$$

Firstly, the filtering operation depends only on the current value of noise model 214 x(n), e.g., no past values need to be stored. Secondly, $\hat{S}(\omega)$ 204 effectively modifies the phase and gain of the noise model 214, or input signal. Generally, if an input signal to a linear time-invariant filter is a pure tone, no matter how the filter is implemented; the effect is a gain and phase modification of the input signal. Thus, there is a redundancy in performing the filtering in the time-domain with longer filters as exemplified in prior art. For the complex-domain approach, the number of multiplies per sample per secondary path filter is 4. So, for example, for J=3, K=4 and M=5, the number of multiply operations in an ANE arising solely from secondary path filtering is around 1.5*4*3*4*5=360, or 0.36 MHz at an input sample rate of 1 kHz. This represents a factor of 50 in computational savings compared to the time-domain filtering approach in the prior art.

FIG. 2 illustrates that the complex-domain approach effectively replaces the two real gains $g_0(n)$ and $g_1(n)$ multiplied respectively with real signals $x_0(n)$ and $x_1(n)$ in FIG. 1, i.e. $y(n)=x_0(n)\,g_0(n)+x_1(n)\,g_1(n)$, with a single complex multiply $y(n)=x(n)g(n)$. y(n) is the complex output of the transformation function 212. The transformation function 206, or adaptive filter module, for example LMS, receives a complex noise model 214 x'(n) as well as the pseudo-error signal 128 e'(n), that is real. A complex gain may be updated using, for example, the FxLMS update from prior art: $g(n+1)=g(n)+\mu x'(n)e'(n)$. Alternatively, an NLMS update may be used: $g(n+1)=g(n)+\mu x'(n)e'(n)/P'(n)$, where P'(n) is the estimated power of x'(n). Additional computational savings may be made in the complex-domain approach by calculating P'(n) offline, rather than estimating it online as done in prior art. Since $x'(n)=x(n)*\hat{S}(\omega)=A\,s_\omega\exp(i(\omega n+\phi_\omega))$, this implies $P'(n)=(A\,s_\omega)^2$. The reference signal amplitude A is generally fixed, and $s_\omega^2$ can be calculated at the calibration/integration stage at a set of discrete frequency bins. P'(n) can be determined during online operation processing a look-up table or executing a frequency-interpolation method.

The complex-domain method may be generalized to multiple frequencies, most conveniently using a parallel form. The complex tone generator, or noise model generator 202, thus generates multiple tones $x_m(n)=A\exp(i\omega_m n)$, which are filtered by $\hat{S}(\omega_m)$ 204 to obtain $x_m'(n)=x_m(n)*\hat{S}(\omega_m)$. $x_m(n)$ are also individually scaled 216 by complex gain values $g_m(n)$ to form $y_m(n)=x_m(n)g_m(n)$, and upstream of both Re{ } 210 blocks in FIG. 2, summations over the individual frequency components, e.g., m, are inserted.

The complex-domain method may also be generalized to multiple channels. Filtering operations by $\hat{S}(\omega)$) 204 are replaced with $\hat{S}(\omega)$ 204, where $k=1, \ldots, K$ and $j=1, \ldots, J$. Complex gain values $g_k(n)$, $k=1, \ldots, K$ are obtained from the adaptive filter update 206, and individual outputs to each actuator are obtained using $y_k(n)=x(n)g_k(n)$.

Figure 3:
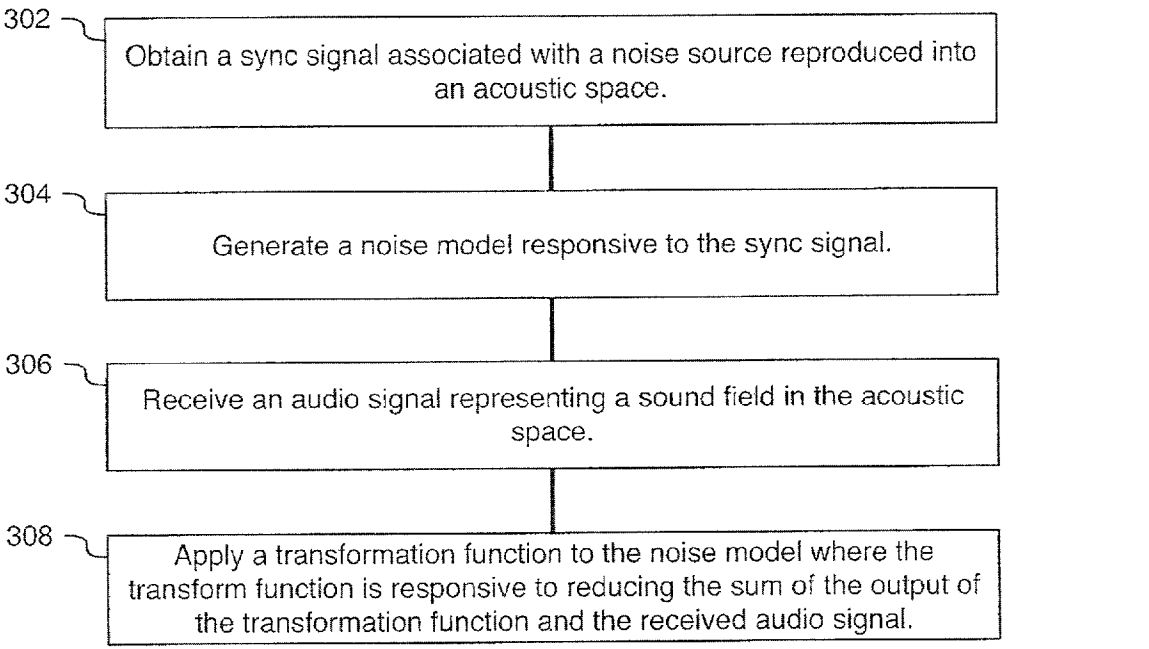
FIG. 3 is a representation of a method for active noise equalization.

FIG. 3 is a representation of a method for ANE. The method 300 may be, for example, implemented using the systems 200 and 400 described herein with reference to FIGS. 2 and 4. The method 300 includes the act of obtaining a sync signal associated with a noise source reproduced into an acoustic space 302. The noise source may be, for example, engine noise generated from a vehicle. A noise model may be generated responsive to the sync signal 304. The noise model may represent the noise source with a complex tone generator. An audio signal may be received representing a sound field in the acoustic space 306. The audio signal may include the noise source. A transformation function may be applied to the noise model where the transform function is responsive to reducing the sum of the output of the transformation function and the received audio signal 308. The transformation function is a complex-domain adaptive filter in some systems.

Figure 4:
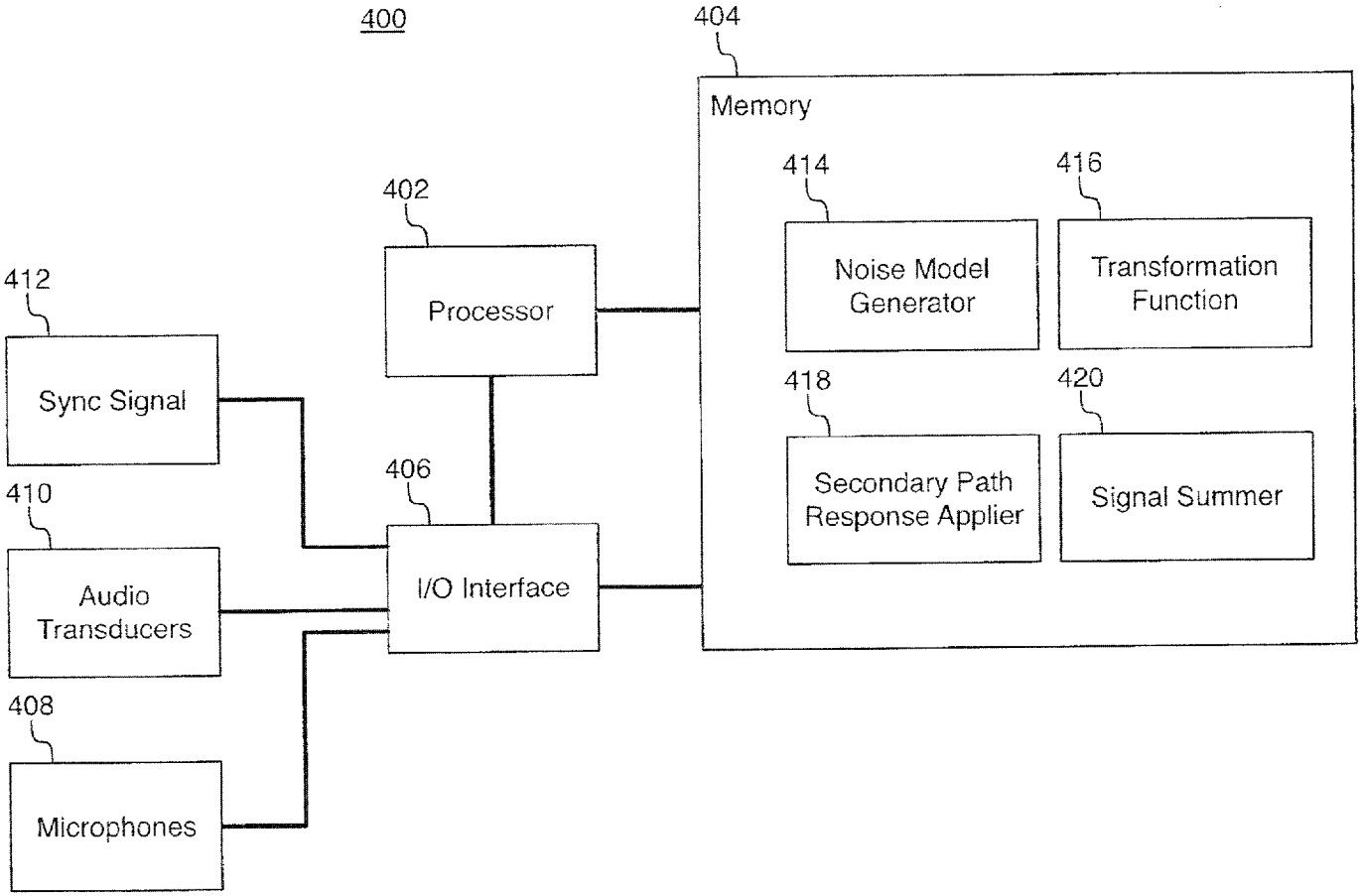
FIG. 4 is a schematic representation of a system for active noise equalization.

FIG. 4 is a schematic representation of a system for ANE. The system 400 comprises a processor 402, memory 404 (the contents of which are accessible by the processor 402) and an I/O interface 406. The memory 404 may store instructions which when executed using the processor 402 may cause the system 400 to render the functionality associated with active noise equalization as described herein. For example, the memory 404 may store instructions which when executed by the processor 402 may cause the system 400 to render the functionality associated with a noise model generator 414, a transformation function 416, secondary path response applier 418 and a signal summer 420.

The noise model generator 414 may be referred to as the noise model generator 202. The transformation function 416 may be referred to as the transformation function 206. The secondary path response applier 418 may apply the estimate of the secondary path transfer function 204. The signal summer 420 may combine the output of the transformation function 212 and the received audio signal 126.

The processor 402 may comprise a controller, a single processor or multiple processors that may be disposed on a single chip, on multiple devices or distributed over more that one system. The processor 402 may be hardware that executes computer executable instructions or computer code embodied in the memory 404 or in other memory to perform one or more features of the system. The processor 402 may include a general purpose processor, a central processing unit (CPU), a graphics processing unit (GPU), an application specific integrated circuit (ASIC), a digital signal processor (DSP), a field programmable gate array (FPGA), a digital circuit, an analog circuit, a microcontroller, any other type of processor, or any combination thereof.

The memory 404 may comprise a device for storing and retrieving data, processor executable instructions, or any combination thereof. The memory 404 may include non-volatile and/or volatile memory, such as a random access memory (RAM), a read-only memory (ROM), an erasable programmable read-only memory (EPROM), or a flash memory. The memory 404 may comprise a single device or multiple devices that may be disposed on one or more dedicated memory devices or on a processor or other similar device. Alternatively or in addition, the memory 404 may include an optical, magnetic (hard-drive) or any other form of data storage device.

The memory 404 may store computer code, such as the noise model generator 414, the transformation function 416, secondary path response applier 418 and the signal summer 420 as described herein. The computer code may include instructions executable with the processor 402. The computer code may be written in any computer language, such as C, C++, assembly language, channel program code, and/or any combination of computer languages. The memory 404 may store information in data structures including, for example, adaptive file coefficients in a non-transitory medium.

The I/O interface 406 may be used to connect devices such as, for example, sync signal source 412, audio transducers 410, microphones 408 and to other components of the system 400. The sync signal source 412 may generate the sync signal 120.

All of the disclosure, regardless of the particular implementation described, is exemplary in nature, rather than limiting. The system 400 may include more, fewer, or different components than illustrated in FIG. 4. Furthermore, each one of the components of system 400 may include more, fewer, or different elements than is illustrated in FIG. 4. Flags, data, databases, tables, entities, and other data structures may be separately stored and managed, may be incorporated into a single memory or database, may be distributed, or may be logically and physically organized in many different ways. The components may operate independently or be part of a same program or hardware. The components may be resident on separate hardware, such as separate removable circuit boards, or share common hardware, such as a same memory and processor for implementing instructions from the memory. Programs may be parts of a single program, separate programs, or distributed across several memories and processors.

The functions, acts or tasks illustrated in the figures or described may be executed in response to one or more sets of logic or instructions stored in or on a non-transient computer readable media. The functions, acts or tasks are independent of the particular type of instructions set, storage media, processor or processing strategy and may be performed by software, hardware, integrated circuits, firmware, micro code and the like, operating alone or in combination. Likewise, processing strategies may include multiprocessing, multitasking, parallel processing, distributed processing, and/or any other type of processing. In one embodiment, the instructions are stored on a removable media device for reading by local or remote systems. In other embodiments, the logic or instructions are stored in a remote location for transfer through a computer network or over telephone lines. In yet other embodiments, the logic or instructions may be stored within a given computer such as, for example, a CPU. The term "in response to" requires that an action necessarily result from a preceding event. It is not sufficient just to follow the preceding event.

While various embodiments of the system and method for active noise equalization have been described, it will be apparent to those of ordinary skill in the art that many more embodiments and implementations are possible within the scope of the present invention. Accordingly, the invention is not to be restricted except in light of the attached claims and their equivalents.

The invention claimed is:

1. A method for active noise equalization comprising:

obtaining a sync signal synchronized to an engine speed from a noise source reproduced into an acoustic space;

generating a noise model, representing one or more complex tones, responsive to the sync signal;

receiving an audio signal representing a sound field in the acoustic space;

applying an estimate of a secondary path transfer function to the noise model in a frequency domain; and applying a transformation function to the noise model where the transform function is responsive to reducing a sum of an output of the transformation function and the received audio signal;

where applying the estimate of the secondary path transfer function comprises an online calculation; and where an output of the secondary path transfer function is limited to a range of frequencies that lies within an aural range.

2. The method for active noise equalization of claim 1, where the synchronized engine speed is generated from a tachometer.

3. The method for active noise equalization of claim 1, where the synchronized engine speed is generated from an engine control unit.

4. The method for active noise equalization of claim 1, where applying the estimate of the secondary path transfer function to the noise model comprises calculating a plurality of frequency components.

5. The method for active noise equalization of claim 4, where the estimate of the secondary path transfer function for the plurality frequency components is stored in a non-transitory media.

6. The method for active noise equalization of claim 1, where the transformation function comprises an adaptive filtering algorithm.

7. The method for active noise equalization of claim 6, where the adaptive filtering algorithm comprises one of a least-mean-square, a normalized least-mean-square, an affine projection or a recursive least-square.

8. A head-unit system for active noise equalization comprising:

one or more processors in the head-unit; and memory storing instructions accessible by the one or more processors, the instructions, when executed by the one or more processors, configuring the system to:

obtain a sync signal synchronized to an engine speed associated with a noise source reproduced in an acoustic space;

generate a noise model representing one or more complex tones responsive to the sync signal;

receive an audio signal representing a sound field in the acoustic space;

apply an estimate of a secondary path transfer function to the noise model in a frequency domain; and apply a transformation function to the noise model where the transform function is based on the noise model and is responsive to reducing a sum of an output of the transformation function and the received audio signal where the one or more processors apply the estimate of the secondary path transfer function through an online calculation; and where an output of the secondary path transfer function is limited to a range of frequencies that lies within an aural range.

9. The head-unit system of claim 8, where the synchronized engine speed is generated from a tachometer.

10. The head-unit system of claim 8, where the synchronized engine speed is generated from an engine control unit.

11. The head-unit system of claim 8, where applying the estimate of the secondary path transfer function to the noise model comprises calculating a plurality of frequency components.

12. The head-unit system of claim 11, where the estimate of the secondary path transfer function for the plurality frequency components is stored in a non-transitory media.

13. The head-unit system of claim 8, where the transformation function comprises an adaptive filtering algorithm.

14. The head-unit system of claim 13, where the adaptive filtering algorithm comprises one of a least-mean-square, a normalized least-mean-square, an affine projection or a recursive least-square.

15. A computer readable medium comprising instructions, stored on a non-transitory medium executable by a processor, for:

obtaining a sync signal synchronized to an engine speed from a noise source reproduced into an acoustic space;

generating a noise model, representing one or more complex tones, responsive to the sync signal;

receiving an audio signal representing a sound field in the acoustic space;

applying an estimate of a secondary path transfer function to the noise model in a frequency domain; and applying a transformation function to the noise model where the transform function is responsive to reducing a sum of an output of the transformation function and the received audio signal;

where applying the estimate of the secondary path transfer function comprises an online calculation; and where an output of the secondary path transfer function is limited to a range of frequencies that lies within an aural range.

16. The computer readable medium of claim 15, where the synchronized engine speed is generated from a tachometer.

17. The computer readable medium of claim 15, where the synchronized engine speed is generated from an engine control unit.

18. The computer readable medium of claim 15, where applying the estimate of the secondary path transfer function to the noise model comprises calculating a plurality of frequency components.

19. The computer readable medium of claim 18, where the estimate of the secondary path transfer function for the plurality frequency components is stored in a non-transitory media.

20. The computer readable medium of claim 15, where the transformation function comprises an adaptive filtering algorithm.

21. The computer readable medium of claim 20, where the adaptive filtering algorithm comprises one of a least-mean-square, a normalized least-mean-square, an affine projection or a recursive least-square.

* * * * *